United States Patent [19]

Haimovitz

[11] Patent Number: 4,796,684

[45] Date of Patent: Jan. 10, 1989

[54] COMPACT DRAPERY SYSTEM

[76] Inventor: Leonard J. Haimovitz, 1059 Summit Rd., Santa Barbara, Calif. 93108

[21] Appl. No.: 53,711

[22] Filed: May 26, 1987

[51] Int. Cl.[4] ..... A47H 1/00

[52] U.S. Cl. ..... 160/330; 16/87.4 R

[58] Field of Search ..... 160/330, 345, 346, 347, 160/348, 123, 124, 125, 126; 16/87.2, 87.4 R, 93 R, 93 D, 94 D, 95 D, 96 D

[56] References Cited

U.S. PATENT DOCUMENTS

| | | | |
|---|---|---|---|
| 2,848,734 | 8/1958 | Ault | 160/345 X |
| 3,251,400 | 5/1966 | Krüll | 16/93 D X |
| 3,286,299 | 11/1966 | Golden | 160/330 X |
| 3,378,879 | 4/1968 | Stall | 160/330 X |
| 3,434,524 | 3/1969 | Fein | 16/87.4 R X |
| 3,626,429 | 10/1969 | Toder | 16/87.2 |
| 3,851,699 | 12/1974 | Shapiro | 160/166 R |
| 4,550,038 | 10/1985 | Becker et al. | 160/330 X |
| 4,582,109 | 4/1986 | Fairbanks | 160/348 X |
| 4,688,620 | 8/1987 | Lechner et al. | 160/348 |

FOREIGN PATENT DOCUMENTS

| | | | |
|---|---|---|---|
| 1144448 | 2/1963 | Fed. Rep. of Germany | 16/87.4 R |

*Primary Examiner*—Ramon S. Britts
*Assistant Examiner*—David M. Purol
*Attorney, Agent, or Firm*—Marvin E. Jacobs

[57] ABSTRACT

A drapery system containing hanger glides which nest together in partial overlapping relationship when said drapery is traversed to retracted position to permit said drapery to occupy a minimum area of an adjacent window, wall or the like. The edge of the head of the glide can be bevelled to avoid binding of the glide when in canted position.

13 Claims, 2 Drawing Sheets

COMPACT DRAPERY SYSTEM

TECHNICAL FIELD

The present invention relates to privacy curtains and, more particularly, the invention relates to a traverse drapery system providing a very compact, low profile, folded drape which loosely stacks in the open position.

BACKGROUND ART

Curtains are required in many locations to shade an area from sun, to provide security by isolating a room so that an intruder cannot see contents or the presence or absence of occupants or for privacy as between classes of seats in a plane or to enclose a hospital bed or a shower opening. Traverse drapes provide convenience since the drapes can easily be opened or closed by means of sliding the drapes to a gathered condition towards the middle or ends of a drapery rod.

The advent of recreational vehicles such as boats, planes, motor homes with limited space has resulted in more compact systems using tracks containing glides. Though such systems are less bulky, they still require excessive space when opened and can block a part of the opening. Even if the glides are tightly gathered, pleated drapes tend to fan out at the bottom. In the closed position, the pleats are bulky since the pleats are curved and space the drape from the wall.

Draperies used in hospitals and in commercial applications such as airplanes need to be washed more often than household drapes. Any metal parts attached to the drapes can either rust or cause tearing of the drapes during agitation during the cleaning. Removal and reinstallation of draperies which utilize hangar pins at each pleat is very labor intensive and expensive.

Drapes that utilize glides also act as a limit on compactness since the top of the gathered drapes has a length equal to the sum of the width of the top member of the glides. Furthermore, the glides can tilt and bind in the track or interlock with each other during traverse of the draperies interfering with smooth opening or closing of the drapery system.

STATEMENT OF THE INVENTION

An improved, low-cost, compact drapery system is provided in accordance with the present invention. Drapes smoothly and reliably traverse in either direction without binding and open to a very low-profile, compact, gathered drape in the open condition. The drapery system of the invention causes less interference with window spaces in the open position and occupies less space then the state-of-the-art systems now being marketed.

The drapery system of the invention utilizes a glide that is ready and permanently connected to the top edge of the draperies without metal. This simplifies hanging and removal of the drapes and also avoids rusting of the pins, spotting of the drapery fabric or tearing of the drapery during cleaning.

The drapery system of the invention provides lower profile by means of novel glides which overlap when gathered together. Each glide has a head portion formed with forwardly and rearwardly extending offset portions which overlap and nest to reduce the width of the gathered glides. The bulk of the open drapes is also minimized by absence of gathered pleats and providing a ready crease at the edge of each pleat, suitably by removing vertical threads of that location. The compactness at the fold and general hanging appearance are also facilitated by providing a horizontal pleat stiffener depending from each glide. The stiffener aids in forming tight pleats and in folding the pleats into a very neat assemblage. The stiffeners also contribute to the smooth and reliable traverse of the drapes in either direction.

The disadvantages of prior art traverse draperies are overcome with the present invention and improved traverse draperies are provided which fold neatly and compactly to minimal size, in their open or retracted position, and which move swiftly and evenly during opening and closing operations. In addition, improved hanger glide members are provided which move smoothly and reliably during traversing operations and which occupy minimal space when the draperies are in their retracted position. This provides maximum view and maximum natural lighting when the drapes are in the open position. In addition, the top stiffener attached to the glides serve to hold the upper edge of the drape in a desired position and facilitate neat and compact folding of the drapery.

The draperies preferably have one or more vertical threads omitted at regular intervals to facilitate folding of the drapery and to cause the adjacent panels of the drapery to lie closely together when the drapery is in the open or retracted position. The glide members are preferably formed of nylon or other suitable self-lubricating, engineering plastic such as Teflon or polyethylene which can withstand washing or dry cleaning operations. The glide member can be formed with a laterally extending stiffener portion which is sewn or thermally or adhesively attached to the upper edge of the adjacent drapery panel. The stiffener extends substantially along the entire upper edge of the panel to support the drapery panel of the drapery during the traversing operations. The stiffener can be formed of a thermoplastic such as PVC and can be thermally welded to the drapery, especially to draperies formed of synthetic materials having a low stiffening point. Preferred draperies are formed of open weave polyester (e.g., Dacron) lace.

Each of the glide members is formed with a neck portion connected to a head portion which extends horizontally from the top of the neck portion. The head enters the channel of the track and is slidable along said track element during the traversing operations. The head portion of the glide member is formed with forwardly and rearwardly extending offset portions which are nestable with the head portions of adjacent glide members to permit the head portions of the glide members to occupy a minimal amount of space in the track element when the drapery is in the open or retracted position. Optionally, the upper surface of the head portion of each glide member is bevelled to prevent jamming during traversing operations and to assure smooth and even movement.

These and other advantages and many attendant features of the present invention will become apparent as the invention becomes better understood by reference to the following detailed description when considered in conjunction with the accompanying drawings.

DETAILED DESCRIPTION OF THE INVENTION

Figure 1:
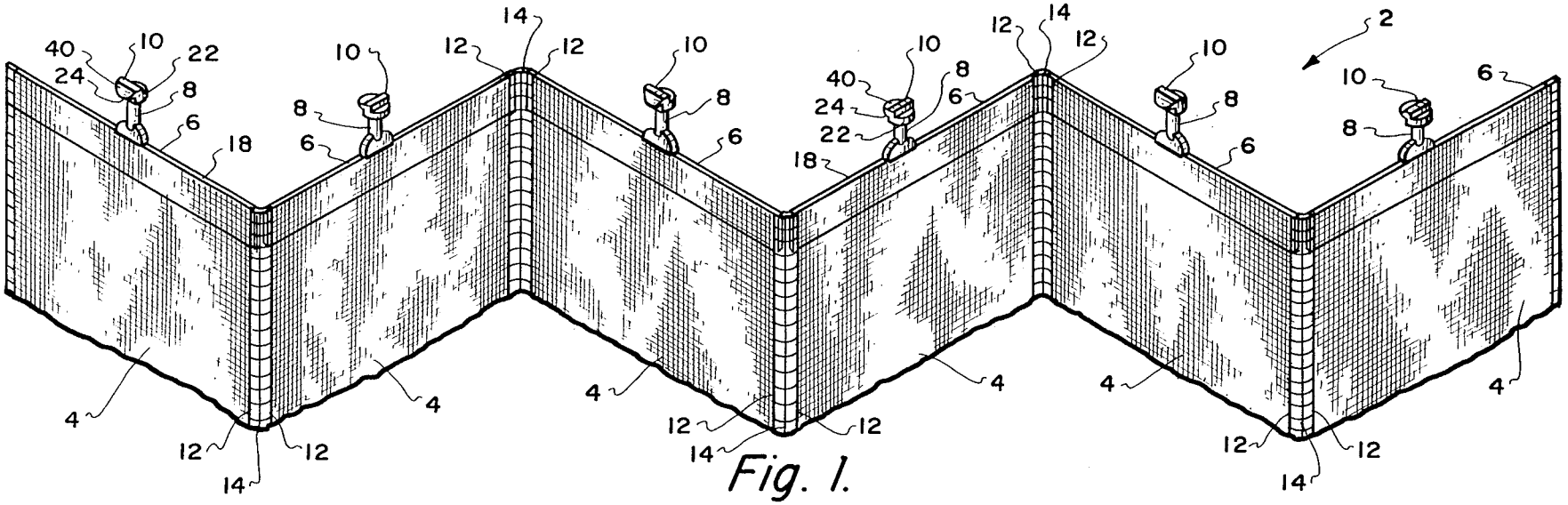
FIG. 1 is an isometric view of the upper portion of a drapery system of the present invention.

Referring to FIG. 1, a drapery 2 is shown folded to define a plurality of panels 4. At the upper edge of the drapery 2, hanger glides 6 are secured to each of the panels 4 and are each formed with upwardly projecting necks 8 having head portions 10 at the upper ends thereof for engagement with suitable tracks means, not shown. Tracks for supporting the drapery 2 from a wall or ceiling and for permitting traversing of the drapery 2 between an open or retracted position and a closed position extending across a window, wall or the like are well-known in the art. A preferred form of track is shown in my copending patent application entitled DRAPERY ROD BRACKET, Ser. No. 053710, filed concurrently herewith.

Figure 3:
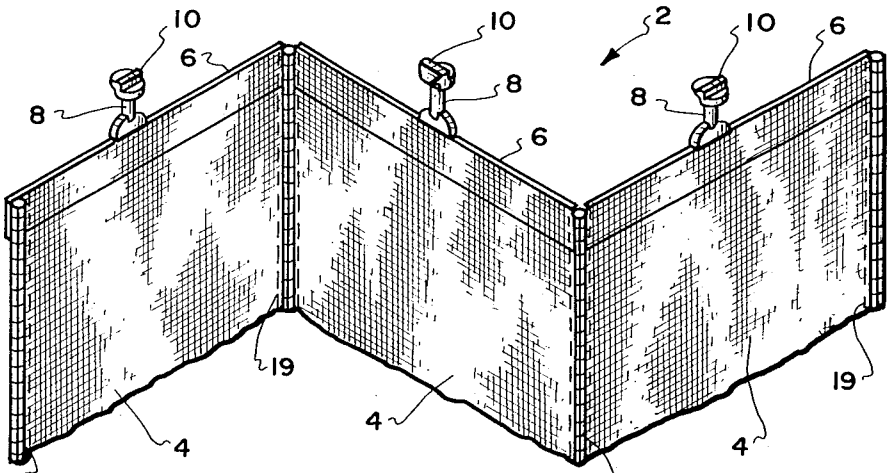
FIG. 3 is a further isometric view showing a portion of a further alternative form of the drapery system having sewn creases.
Figure 2:
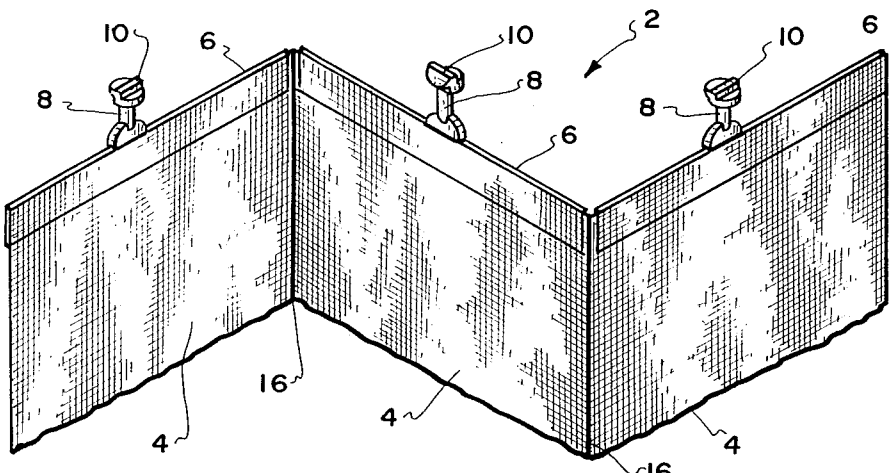
FIG. 2 is another isometric view showing a portion of an alternative form of the drapery system having pressed creases.

To facilitate close gathering of the drapery 2, during traversing operations, a sharp fold is formed suitably by omitting one or more vertical threads as seen at 12, on either side of a pivotal thread 14. This permits the adjacent panels 4 to fold sharply and closely pack together when the drapery is traversed to its retracted position. The retracted drapery will cover a minimum portion of the adjacent window, wall or the like. Alternatively, if desired, the threads which were omitted at 12 in FIG. 1 may be retained and the folds may be pressed, as seen at 16 in FIG. 2, or sewn, as seen at 19 in FIG. 3.

Figure 4:
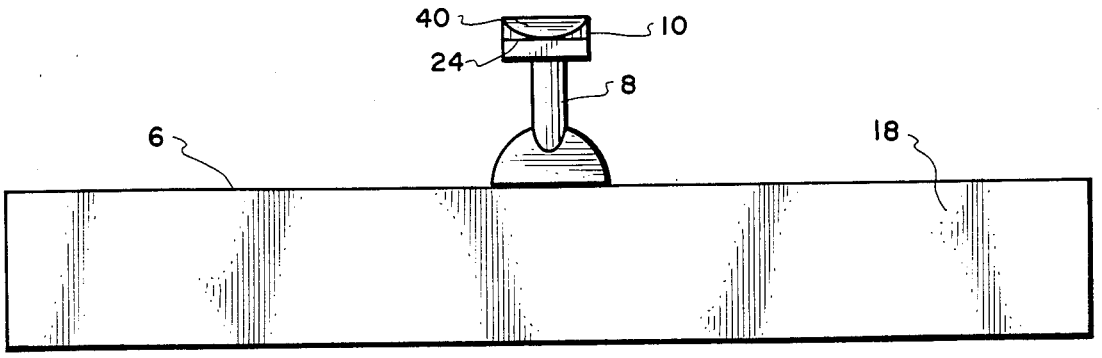
FIG. 4 is a front view in elevation of one of the hanger glides of the drapery system of FIG. 1.
Figure 5:
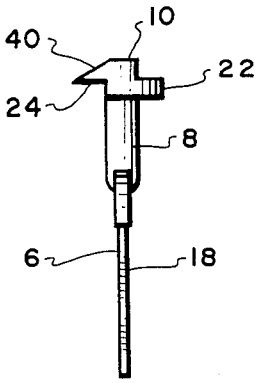
FIG. 5 is an end view of the hanger glide shown in FIG. 4.

As best shown in FIGS. 4 and 5, the hanger glides 6 are each formed with a flat elongated base portion 18 having a neck portion 8 projecting upwardly from the center of said base portion and having a head 10 carried at the upper end of the neck 8. The glides 6 are preferably formed of nylon which can withstand washing or dry cleaning operations while attached to the drapery 2. The base portion 18 is preferably formed of sufficient thickness to enable it to retain its shape and to support the upper edge of the drapery panel 4, under normal usage conditions, yet is thin enough to permit penetration therethrough by a moderately strong needle to enable the slide 6 to be sewn onto the drapery 2. If desired, rows of apertures may be provided along the upper and lower edges of the base portion 18 to facilitate such sewing. Alternately, the edge of the drapery can be adhesively secured or thermally wedged to the drapery.

Figure 6:
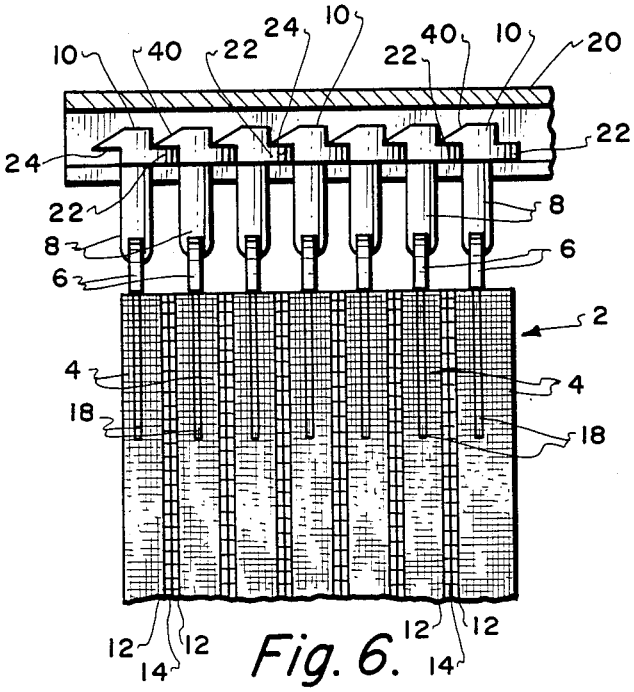
FIG. 6 is a diagrammatic representation, partly in section, showing the drapery system of FIG. 1 in retracted position.

FIG. 6 shows the drapery of FIG. 1 in its retracted position with a plurality of hanger glides 6 drawn into proximity adjacent one end of a supporting track member, indicated in partial section at 20. The head 10 of the hanger slide 6 is formed with a forwardly projecting lip 22 and a rearwardly projecting flange 24 which is vertically offset upwardly from the lip 22 sufficiently to permit the flange 24 to vertically overlie the lip 22 of an adjacent slide 6 when the drapery is in its retracted position. As shown, the lip 22 of the head 10 rests overlying and engaged upon the lower horizontal portion of the track 20, whereas the flange 22 of the head 10 is spaced above it through a distance at least slightly greater than the vertical thickness of the lip 22 such that the vertical offset positioning of the lips 22 and flanges 24 enable the heads 10 to nest together, in a partial overlapping arrangement in a vertical plane, which permits the heads 10 to occupy minimal space and, hence, permits the drapery 2 to cover a minimum area of the adjacent window, wall or the like in the retracted position.

Figure 7:
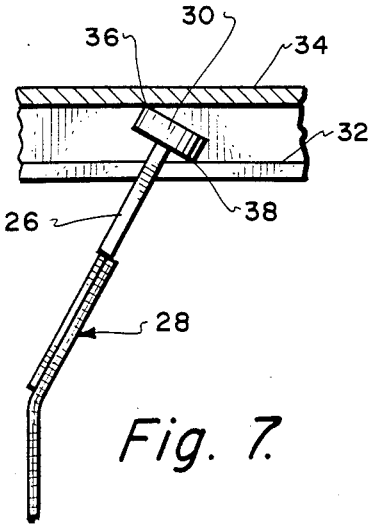
FIG. 7 is a diagrammatic representation showing a hanger glide binding during a traversing operation.
Figure 8:
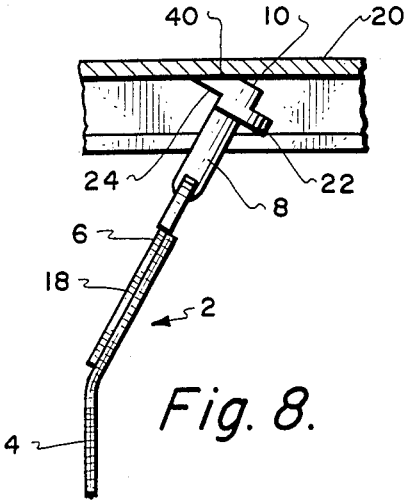
FIG. 8 is a diagrammatic representation showing the improved hanger glide of the present invention during a traversing operation.

A problem with the hanger glides used previously, such as shown in FIG. 7 is that they tend to jam during traversing operations. As seen in FIG. 7 the hanger glide, indicated generally at 26, is attached to the upper edge of a drapery 28 and has a head 30 which is generally in the form of a cylindrical disc. When the drapery 28 is traversed, the head 30 of the hanger glide 26 tends to become canted and the edges of the head 30 tend to bind in the channel 32 of the supporting track 34, as seen at 36 and 38 in FIG. 7. In contrast, the upper flange 24 of the head 10 of the hanger glide 6 of the present invention is bevelled rearwardly, as seen at 40. Thus, if the hanger glide 6 becomes canted during a traversing operation, the bevelled surface 40 will present a smooth surface to the track 20, instead of sharp edge, and will prevent binding and jamming of the hanger glide 6 within the track 20.

Obviously, if desired, numerous variations and modifications may be made without departing from the present invention. Therefore, it should be clearly understood that the form of the present invention described above and shown in the figures of the accompanying drawing are illustrative only and not intended to limit the scope of the present invention.

I claim:

1. A drapery system comprising:

a drapery composed of a sheet of fabric folded to define a plurality of contiguous panels;

a track means for supporting said drapery from an adjacent structure, said track means having a lower track portion; and a plurality of hanger glides secured to said panels to support said drapery from said track means, each of said hanger glides comprising a flat, elongated base portion secured to an upper edge of a respective one of said panels, a neck portion connected to and projecting upwardly from said base portion, and a head portion mounted at an upper end of said neck portion, said head portion having a forwardly projecting lip disposed in overlying, engaged relation upon said lower track portion and a rearwardly projecting flange vertically offset upwardly from said lip and spaced above said lower track portion through a distance at least slightly greater than the vertical thickness of said lip so as to permit said flange to overlie and overlap in a vertical plane the lip of an adjacent hanger glide and thereby enable said head portions of adjacent hanger glides to nest together in a partial overlapping arrangement in a vertical plane when said drapery is in its retracted position.

2. The drapery system of claim 1 further comprising:

a plurality of pivotal threads each defining the vertical juncture between adjacent panels of said drapery, and at least one vertical thread removed from the panels on each side of said pivotal thread to facilitate folding of said drapery druing traversing operations.

3. The drapery system of claim 1 further comprising pressed creases defining the juncture between adjacent panels of said drapery.

4. The drapery system of claim 1 further comprising sewn creases defining the juncture between adjacent panels of said drapery.

5. The drapery system of claim 1 further comprising said hanger glides being formed of a self-lubrication synthetic resin material.

6. The drapery system of claim 1 further in which said hanger glides are formed of nylon.

7. The drapery system of claim 1 further comprising the base portion of each of said hanger glides being sufficiently thick and stiff to support the upper edge of the associate panel in a desired position during normal usage.

8. In a drapery system including a drapery formed of a sheet of fabric folded to define a plurality of continuous panels, a track having a lower track portion for supporting said drapery from an adjacent structure and a plurality of hanger glides received in the track and secured to said panels to support the drapery from the track, the improvement comprising an improved hanger glide comprising in combination:

a flat, elongated base portion for being secured to an upper edge of a respective one of said panels;

a neck portion connected to and projecting upwardly from said base portion; and a head portion mounted at an upper end of said neck portion, said head portion having a forwardly projecting lip disposed in overlying, engaged relation upon said lower track portion and a rearwardly projecting flange vertically offset upwardly from said lip through a distance at least slightly greater than the vertical thickness of said lip so that said flange is above the support track and overlies and overlaps in a vertical plane the lip of an adjacent hanger glide and thereby enable head portions of adjacent hanger glides to nest together in a partial overlapping arrangement in a vertical plane when the drapery panel is in its retracted position.

9. The drapery system of claim 8 in which the base portion of each hanger glide includes an elongated, horizontal stiffener for supporting a fold of drapery.

10. The hanger glide of claim 8 in which said drapery system are formed of a self-lubricating synthetic resin.

11. The drapery system of claim 8 in which the resin is nylon and the base portion of each of said hanger glides is sufficiently thick to support the upper edge of the associate panel in a desired position during normal usage.

12. The drapery system of claim 8 further comprising the upper surface of the flange of said hanger glide being bevelled rearwardly to prevent jamming of said flange against the supporting track during traversing operations.

13. In a drapery system including a drapery formed of a sheet of fabric folded to define a plurality of continuous panels, at track having a lower track portion for supporting said drapery from an adjacent structure and a plurality of hanger glides received in the track and secured to said panels to support the drapery from the track, the improvement comprising an improved hanger glide comprising in combination:

a flat, elongated base portion for being secured to an upper edge of a respective one of said panels;

a vertical neck portion connected to and projecting upwardly from said base portion; and a head portion mounted at an upper end of said neck portion, said head portion having a forwardly projecting lip disposed in overlying, engaged relation upon the lower track portion of the support track and a rearwardly projecting flange vertically offset upwardly from said lip so that said flange is spaced above the lower track portion through a distance at least slightly greater than the vertical thickness of the lip so as to permit said flange to overlie and overlap in a vertical plane the lip of an adjacent hanger glide and thereby enable said head portion of adjacent hanger glides to nest together in a partial overlapping arrangement in a vertical plane when said drapery is in its retracted position, said flange containing a bevelled surface adapted to engage the support track to minimize jamming of said head portion in the track when said head portion is in a canted position.

* * * * *